United States Patent [19]

Coe et al.

[11] 4,317,045

[45] Feb. 23, 1982

[54] FLAME MONITORING APPARATUS AND METHOD

[75] Inventors: Charles D. Coe; Donald Bell; Michael R. Bray, all of Dronfield, England

[73] Assignee: Land Combustion Limited, Chesterfield, England

[21] Appl. No.: 177,371

[22] Filed: Aug. 12, 1980

Related U.S. Application Data

[63] Continuation-in-part of Ser. No. 895,531, Apr. 11, 1978, abandoned.

[30] Foreign Application Priority Data

Apr. 12, 1977 [GB] United Kingdom ..... 15103/77

[51] Int. Cl.[3] ..... H01J 40/14

[52] U.S. Cl. ..... 250/554; 250/578

[58] Field of Search ..... 250/554, 578; 340/578

[56] References Cited

U.S. PATENT DOCUMENTS 3,824,391 7/1974 Nolting et al. .

*Primary Examiner*—David C. Nelms

*Assistant Examiner*—Darwin R. Hostetter

*Attorney, Agent, or Firm*—Lowe, King, Price & Becker

[57] ABSTRACT

A method of monitoring a selected flame in a multi-burner furnace comprises positioning two arrays of photoelectric sensors, providing an optical path for the sensors of each array so that the line of sight of one sensor of one array will intersect the line of sight of one sensor of the other array, electronically scanning the two arrays to determine the sensors, one from each array, which give maximum correlation of output signals from the sensors to electronically optimize the signals generated from selected sensors, and electronically locking on to the selected sensors to monitor the selected flame.

7 Claims, 15 Drawing Figures

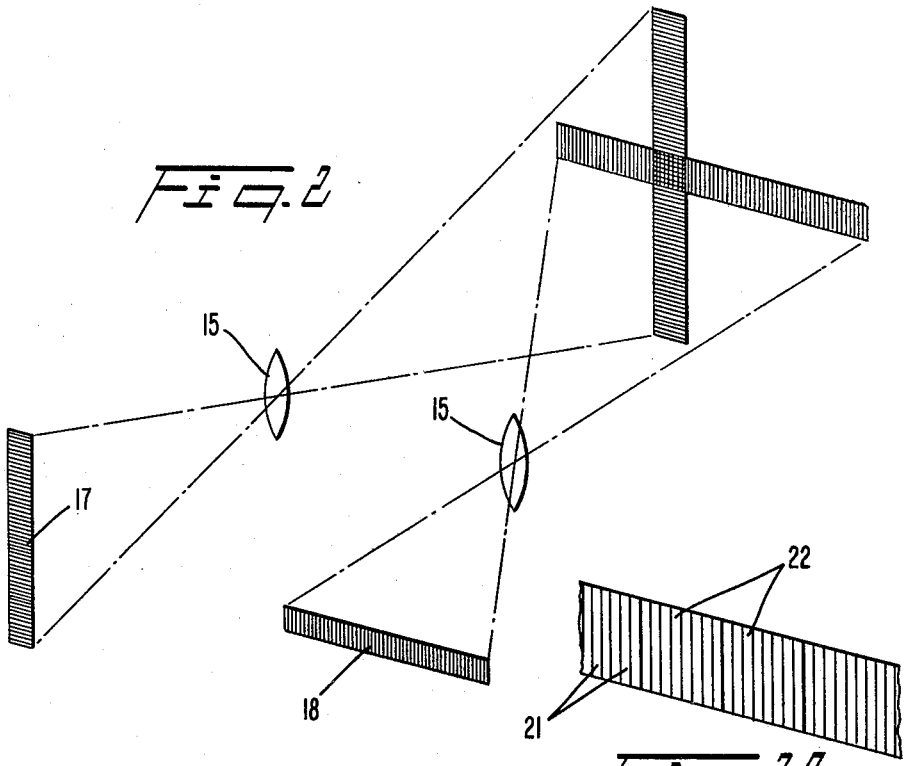
Fig. 2
Fig. 2A
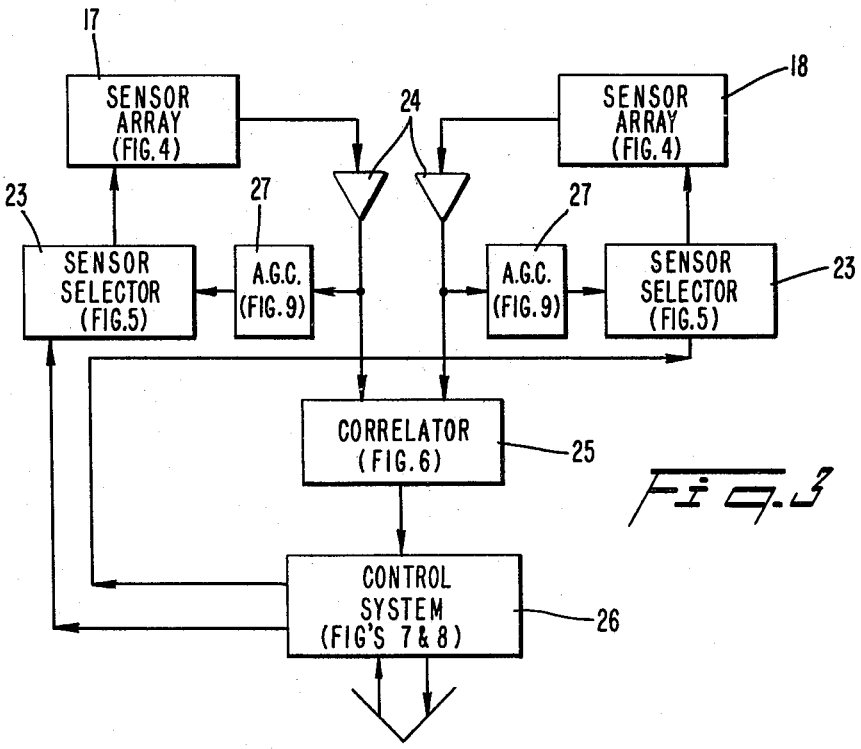
Fig. 3

24
30
+5V
+5V
12'
11'
13'
Ø1
Ø2
17
SS.1
-15V
38
32
34
42
INPUT GATE 1
8'
36
RESET GATE 1
9'
40
-5V
-5V
POWER SUPPLY ONLY
-15V
CHARGE INTEGRATOR
10'
SAMPLE CONTROL 1
45
24
ARRAY 2
18
+5V
14'
S.S.2
-15V
30
1'
INPUT GATE 2
RESET GATE 2
2'
-5V
-15V
CHARGE INTEGRATOR
SAMPLE CONTROL 2
3'

+5V
PAUSE
V BATT.
M/$\overline{IO}$
$\overline{A11}$
$\overline{A10}$
MEM. ADR.2
MEM. ADR.1
39
D/$\overline{C}$
E/$\overline{NE}$
O/C
A11
A10
A9
A8
A7
A6
A5
A4
A3
A2
A1
A0
0V
+5V
PAUSE
D0
D1
D2
D3
D4
D5
D6
D7
M/$\overline{IO}$
$\overline{RW}$
O/C
OP REQ
O/C
RESET
OV LOG
X FLAG
X VEROPINS
X
RUN
38
15
21
25
100
16
0V
A0
A1
A2
A3
A4
D0
D1
D2
D3
D4
D5
D6
D7
8
MEMAD°
104
E/$\overline{NE}$
M/$\overline{IO}$
R/$\overline{W}$
OP REQ.
A0
A1
WRITE 3
OP REQ.

MULTIPLEXER
0V
+5V
82
BATTERY I/P
AGC. CONT. PT 2
AGC. CONT. PT 1
SIG. STRENGTH 2
ARRAY 1
CORRELATION
RUN
RELAY
AUXILLIARY IN/OUT INDICATION
D3 D2 D1 D0
84
28 T1
FAIL SAFE CIRCUIT
TX
RESET
19 RESET
10 OP REQ
6 WRITE 0
29 A/D ADR.
16 Y
SEL 2M
SEL 2L
SEL 1M
SEL 1L
24'
27'
40'
26'
28'
29'
25'
23'
B3
B2
B1
B0
LATCH
49
SELECT CODE TO SELECTOR CIRCUIT 74

FLAME MONITORING APPARATUS AND METHOD

CROSS REFERENCE TO RELATED APPLICATIONS

This application is a continuation-in-part of application Ser. No. 895,531, filed Apr. 11, 1978, now abandoned.

FIELD OF THE INVENTION

This invention relates to a method of and apparatus for monitoring flames in multi-burner furnaces such as boilers for large power generating stations, and is particularly, but not necessarily exclusively concerned with boilers fired by pulverized solid fuel.

DESCRIPTION OF THE PRIOR ART

In British Specification No. 1,396,384 there is disclosed a method and apparatus for monitoring a selected flame in a multi-burner where the selected flame is photoelectrically viewed along two lines of sight which intersect in the flame. Two photoelectric pickups are provided each including a photo-sensor producing an electrical output signal having alternating components corresponding to the varying intensity of the radiation from the flame, and means are provided for determining the degree of correlation between the two signals.

However, to enable the apparatus, and thus the method, to function correctly, it is essential that each photo-sensor is correctly positioned so that the optical sight paths overlap where the flame front is present. The adjustment of the sight paths is effected manually by physically adjusting the position of the photo-sensors when the apparatus is installed on plant, and is a highly skilled operation that has to be effected in a hostile atmosphere.

A second problem of the method and apparatus of No. 1,396,384 is in relation to its use on pulverized fuel (coal) burners, where firstly a gas flame is used to ignite an oil flame, and the oil flame used to ignite the pulverized fuel flame. The oil burner gun is frequently in the center of the pulverized fuel burner, and it is important that the flame monitoring device is able to detect firstly the presence of the oil flame and secondly the presence of the pulverized fuel flame. With the apparatus of No. 1,396,384, only a single cross-correlation point is provided at each setting of the photo-sensors and accordingly, manual adjustment is necessary from their positions where one flame is being monitored to their positions where the other flame is being monitored.

SUMMARY OF THE INVENTION

According to the present invention, a method of monitoring a selected flame in a multi-burner furnace comprises positioning two arrays of photoelectric sensors, providing an optical path for the sensors of each array so that the line of slight of one sensor of one array will intersect the line of sight of one sensor of the other array, electronically scanning the two arrays to determine the sensors, one from each array, which give maximum correlation of output signal from the sensors and electronically locking onto those two sensors to monitor the selected flame.

Preferably, the optical path for each array of sensors is provided by a lens arrangement between the array of sensors and the flame, one array of sensors and its lens being so positioned in relation to the other array of sensors and its lens that the sight paths of the two arrays always cross at any distance further than approximately 5 feet from the lenses. If then a flame is present at any point farther than 5 feet from the lenses, it is possible to find the two cells one from each array which give a maximum correlation of output signal from the sensors.

Whilst each array of sensors may comprise a number (e.g. 12) of individual sensor elements, with the sensor elements set in line and with one array of sensors disposed at right angles to the other array, practical difficulties in the initial setting of the arrays can lead to a situation where during use, it is unlikely that the image of one sensor element of one array will overlap exactly with the image of a corresponding sensor element in the other array, thereby reducing the initial degree of correlation detected during electronically scanning the two arrays. It is therefore preferred to group the sensor elements into blocks of, e.g., eight elements for initial scanning purposes.

Then having found the two individual sensor element blocks giving the greatest degree of correlation, the degree of correlation can then be optimized as follows. Dealing first with one array, the individual block already determined during the scanning procedure as being the block of that array giving maximum correlation, that individual block is moved first in one direction and then in the other, by electronic means, by the addition of one element at one end and the elimination of one element at the other end until the block of eight elements of that array provides a new maximum correlation. Then the individual block of the other array determined on first scanning as giving maximum correlation is dealt with in similar manner again by moving the block by one element at a time first in one direction and then the other until an absolute maximum correlation has been achieved. By this technique it is possible to optimize the correlation between the two blocks first determined to provide 80% to 95% correlation. Having achieved this, those elements constituting an individual block from each array giving absolute maximum correlation are electronically locked to monitor the selected flame. During operation of the method, the equipment is set such that if the degree of correlation is reduced to approximately 20%, there is signalled that the flame is out. To provide an appropriate safety margin, a threshold level can be set at approximately 40% correlation below which flame out is signalled. The method of the invention, in contrast to all known forms of flame detection techniques, has the highly advantageous feature that a fault in the flame can also be reliably detected, it being faulty flames that are likely to be extinguished. Thus, a second threshold of approximately 70% correlation can be provided and utilized to signal (1) that there is a faulty flame condition, and (2) that the correlation optimizing technique is reeffected to ensure that the decreased correlation is not the result of a drift in the original signals or a fault in the equipment.

The distinct advantage of the process of the invention is that particularly when monitoring pulverized fuel flame, the equipment can first be utilized to detect and monitor the presence of the oil flame following the scanning and optimizing process discussed above, and the two appropriate sensor element blocks locked to monitor the oil flame. The equipment can then be utilized to monitor the pulverized fuel flame following the technique discussed above and two different sensor element blocks locked on to the pulverized fuel flame. This being so the equipment, in exceedingly simple manner, can be utilized to detect and monitor the presence of both flames to ensure that pulverized fuel is not fed to a burner which has an extinguished oil flame, thereby constituting a significant advance on techniques known hitherto.

According to a further feature of the invention, a monitoring device for flames in multi-burner furnaces comprises two arrays of photoelectronic sensors, lens means associated with each array to provide an optical path for the sensors of each array, the lines of sight of which intersect, electronic means to scan the two arrays to detect the sensors, one from each array, giving maximum correlation to output signal, and electronic means to optimize the output signals from the sensors of each array.

Thus, the monitoring device according to the invention provides an electronic control system to measure the outputs from the sensors constituting the arrays and instructs sensor selectors associated with each array by means of a digitial code to accept the output of the chosen selectors. The electronic means also determine when maximum correlation by the optimizing steps discussed above has been achieved to lock the sensor selectors on to the appropriate sensors.

BRIEF DESCRIPTION OF THE DRAWINGS

One embodiment of the invention will now be described with reference to the accompanying drawings, in which:

FIG. 2 is a schematic representation of the apparatus of FIG. 1;

FIG. 2A is an enlarged view of a portion of a sensor array shown in FIG. 2;

FIG. 3 is a block circuit diagram showing the interconnections in a system embodying the monitoring apparatus of FIG. 1;

DETAILED DESCRIPTION OF THE INVENTION

Figure 1:
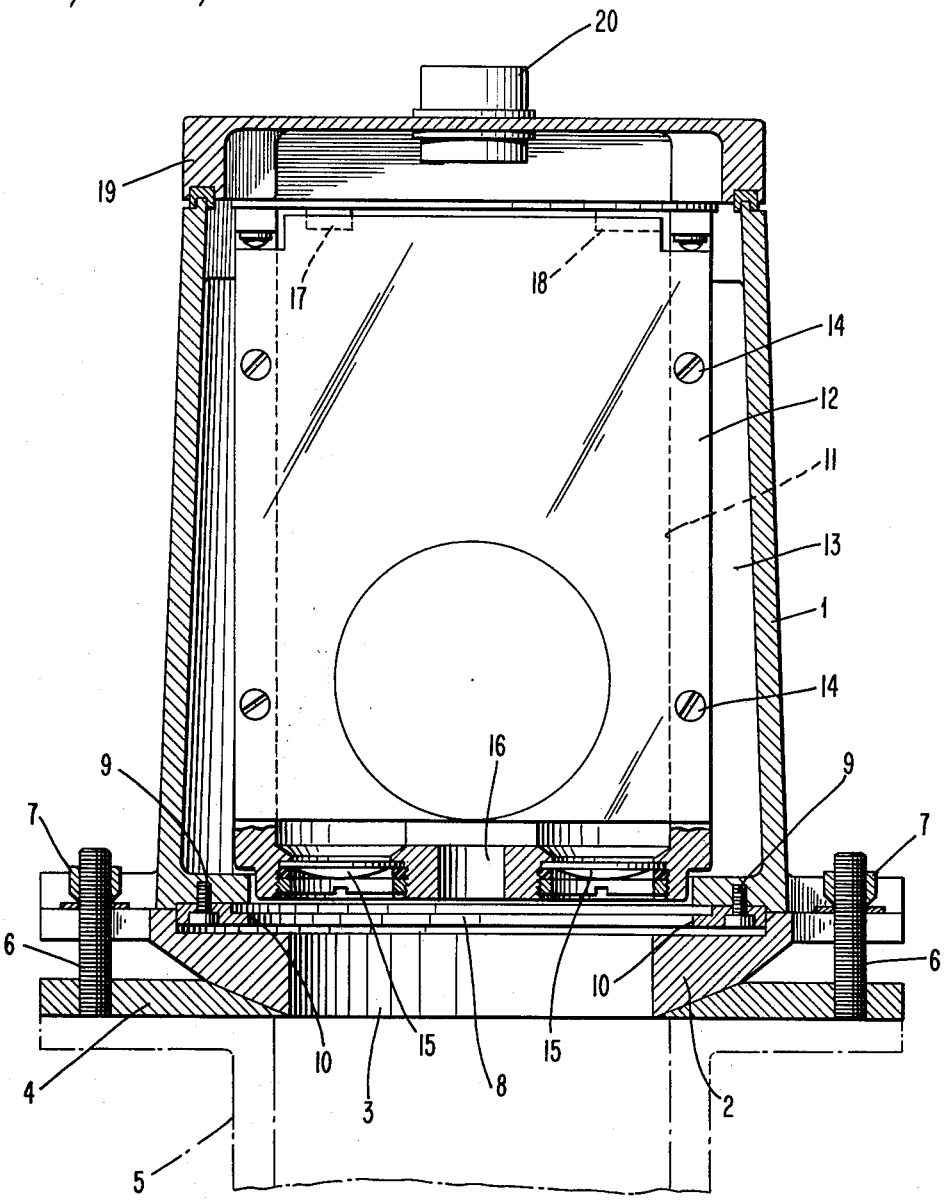
FIG. 1 is a sectional side elevation of flame monitoring apparatus according to the invention.

In FIGS. 1 and 2, a monitoring device for flames in multi-burner furnaces has a housing 1 having at one end an end cap 2 with a central opening 3. The end cap 2 is secured to a front mounting flange 4 adapted for attachment to a boiler mounting tube 5. Screwed studs 6 pass from the flange 4 through the end cap 2 to adjusting nuts 7. Thus with the housing bolted to the end cap 2, the precise positioning of the housing can be adjusted by rotating the nuts 7.

Between the end cap and the housing, a protective window 8 is provided located by screws 9 in a recess in the base of the housing, there being a corresponding recess in the end cap 2 for correct seating. The window 8 is provided with seals 10 to seal the inside of the housing.

Within the housing 1 is an inner body 11 having flanges 12 for securing of the inner body to internal flanges 13 within the housing, by screws 14. At the end of the inner body towards the end cap 2, two optical lenses 15 are provided, between which lies a central sighting hole 16. At the opposite end of the body 11, two arrays of sensors 17, 18 are located, with one array lying at 90° to the other. The outer end of the housing 1 is closed by an end cap 19 having a central sighting aperture 20.

Thus, during construction of the device, the lenses 15 are set such as to provide sensor array images which are coincident at a point in space where a flame will be present, and when the housing 1 is secured to the boiler tube 5, the sighting aperture 20 and sighting hole 16 allow the flame to be observed and the housing adjusted by the nuts 7 to focus the lenses 15 in the flame, as has been represented diagrammatically in FIG. 2. As a result, both arrays of sensors 17, 18 "see" the same part of the flame, when present, to provide a high degree of correlation between the signals, the degree of correlation being optimized as will be explained below.

Each array of sensors 17, 18 which is preferably a self-scanned photodiode array such as an IPL-104 manufactured by Integrated Photomatrix, Ltd. in Dorchester, Dorset, United Kingdom, is formed by ninety-six separate sensor elements 21 arranged in blocks 22 of eight. The sensor arrays then give out signals which are scanned electronically to determine which two blocks of eight sensors give the greatest degree of correlation. It is, however, highly unlikely that the two sensor blocks selected will exhibit maximum correlation. Therefore, taking one block at a time, an individual sensor element is removed from one side and an individual sensor element added to the other side. If the degree of correlation increases, the process is repeated until such time as the correlation decreases from the previous reading and the previous condition reverted to. Then the block 22 of the other array is subjected to the same process until such time as the eight sensor elements from each array giving absolutely maximum correlation have been determined, and the equipment is electronically locked on to them. Naturally, if the first elimination and adding of a sensor element decreases the degree of correlation, the direction of movement of adding and eliminating sensor elements is reversed, and the process continued as before until maximum correlation is achieved.

Figure 5:
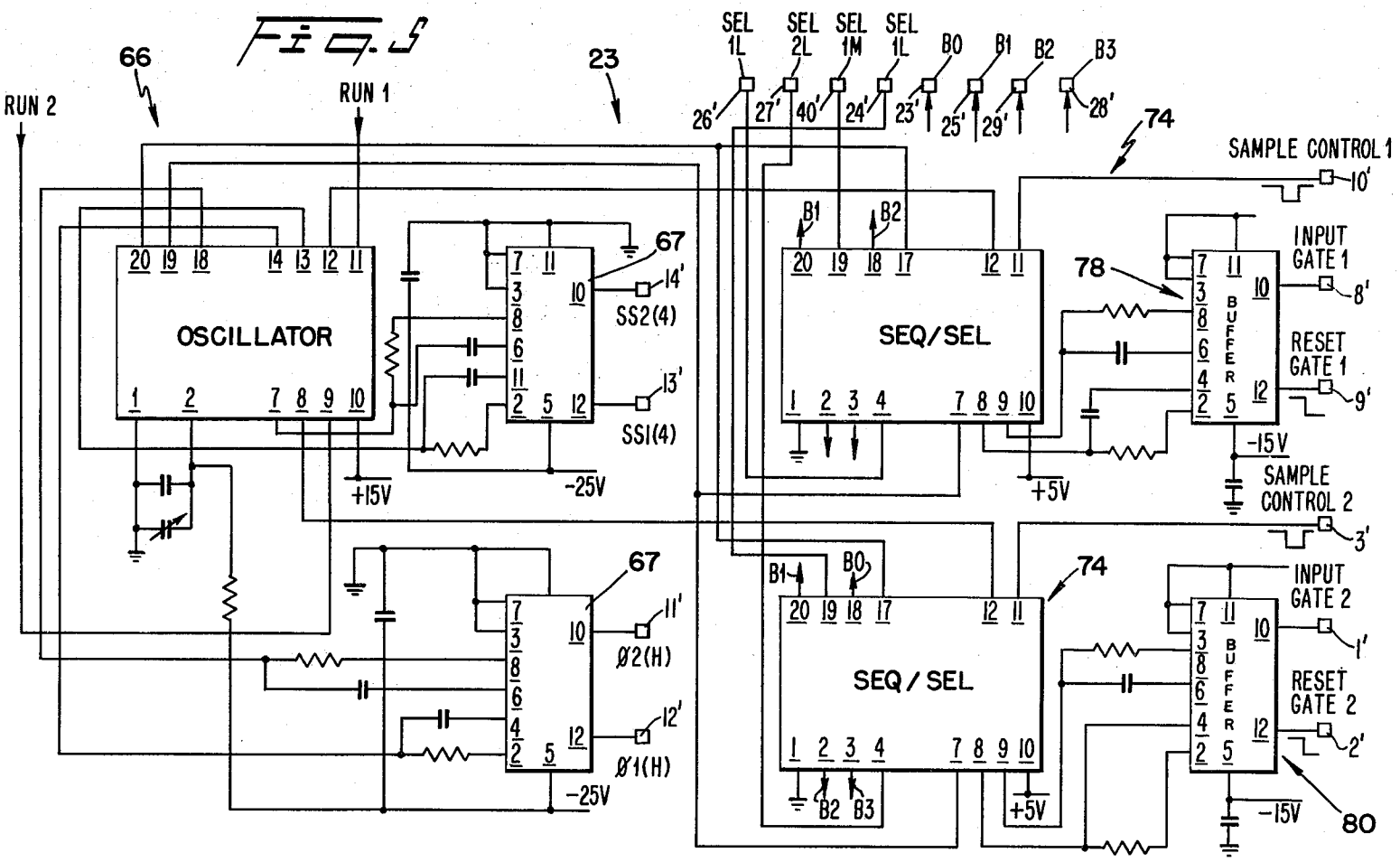
FIG. 5 is a circuit diagram of the selector circuit of FIG. 3.
Figure 6:
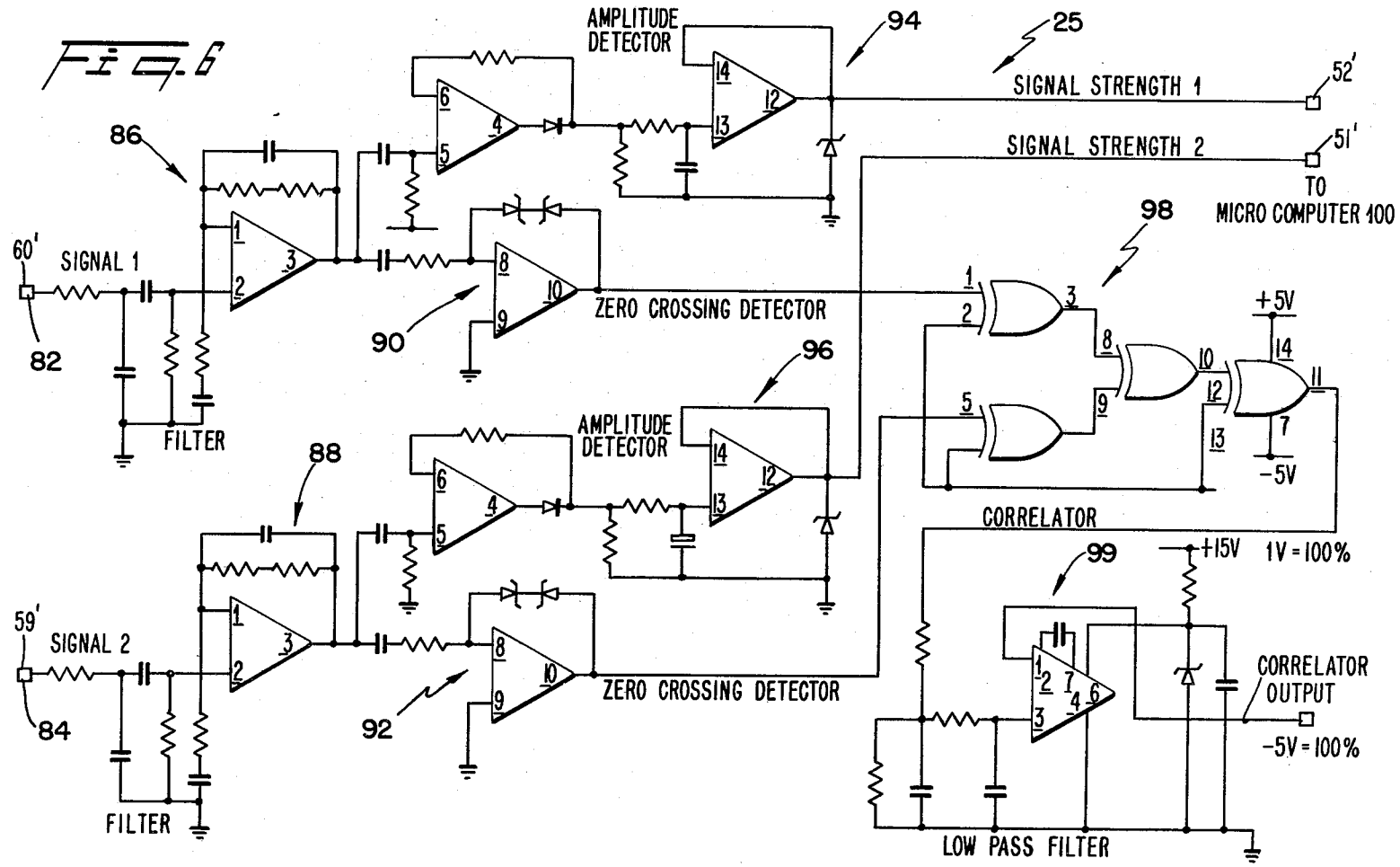
FIG. 6 is a circuit diagram of the correlator circuit of FIG. 3.

A system for providing scanning and output correlation of sensor arrays 17, 18 to select the particular sensors from each array in best view of the flame to be monitored will now be described in detail with reference to FIGS. 4–9. As an overview, however, in FIG. 3, there is shown in block diagram form the electronic equipment for scanning, optimizing, correlating and providing a read out signal for a visual and/or audible indication of flame "IN" or flame "OUT". Associated with each array of sensors 17, 18 is an amplifier 24, the array circuit including the arrays and their amplifiers being shown in FIGS. 4A and 4B. Each array 17, 18 is signalled by a sensor selector 23, the circuit diagram for which is shown in FIG. 5. The signals from the sensor arrays 17, 18 are fed through amplifiers 24 to a correlator 25, the circuit diagram for which is shown in FIG. 6. The correlator feeds its output signal to a control system 26, the circuit diagram for which is shown in FIGS. 7 and 8. Two control boards are utilized purely for convenience.

In FIG. 9 is shown the circuit diagram of an automatic gain control 27 which although is not essential to the invention is highly advantageous in providing an ability to compensate for poor light conditions reaching the sensors, e.g., if the window 8 becomes dirty or when a cloudy flame is being monitored.

Thus, during the operation of the equipment and the method, a request signal is sent to the control system 26 which then feeds selected codes to each of the sensor selectors 23 which in turn scan the signals being emitted by the blocks of sensors in each array 17, 18. The signals from the arrays are then fed through the amplifiers 24 to the correlator 25, with a signal from the correlator showing the degree of correlation between two selected sensor blocks being fed through the control system and out as a reply signal. The optimizing of the degree of correlation as has been explained above is automatically achieved by the control system.

When the optimum correlation has been achieved the two new eight sensor element blocks are locked onto such that the output signal from the control system can be utilized to activate, e.g., a visual display system to give constant monitoring of the flame. As has been referred to above, if the extent of degree of correlation is seen to fall to approximately 70% action can be taken to inspect the flame shown to be faulty. Equally if the degree of correlation falls below 40% immediate action can be taken on the premise that the flame is out. The control circuit shown in FIGS. 7 and 8 also embody simple electronic means to bring about the automatic shutdown of a control burner on the sensing of a signal indicating less than 40% correlation.

Referring now to FIGS. 4–9, detailed circuitry for providing the functions shown in the block diagram of FIG. 3 will be described. The blocks shown in those Figures are commercially available integrated circuits that will be identified by model number so as to be obtainable from major manufacturers of integrated circuit components. Circuit connections to those integrated circuits are made with reference to component pin numbers (underscored).

Figure 4A:
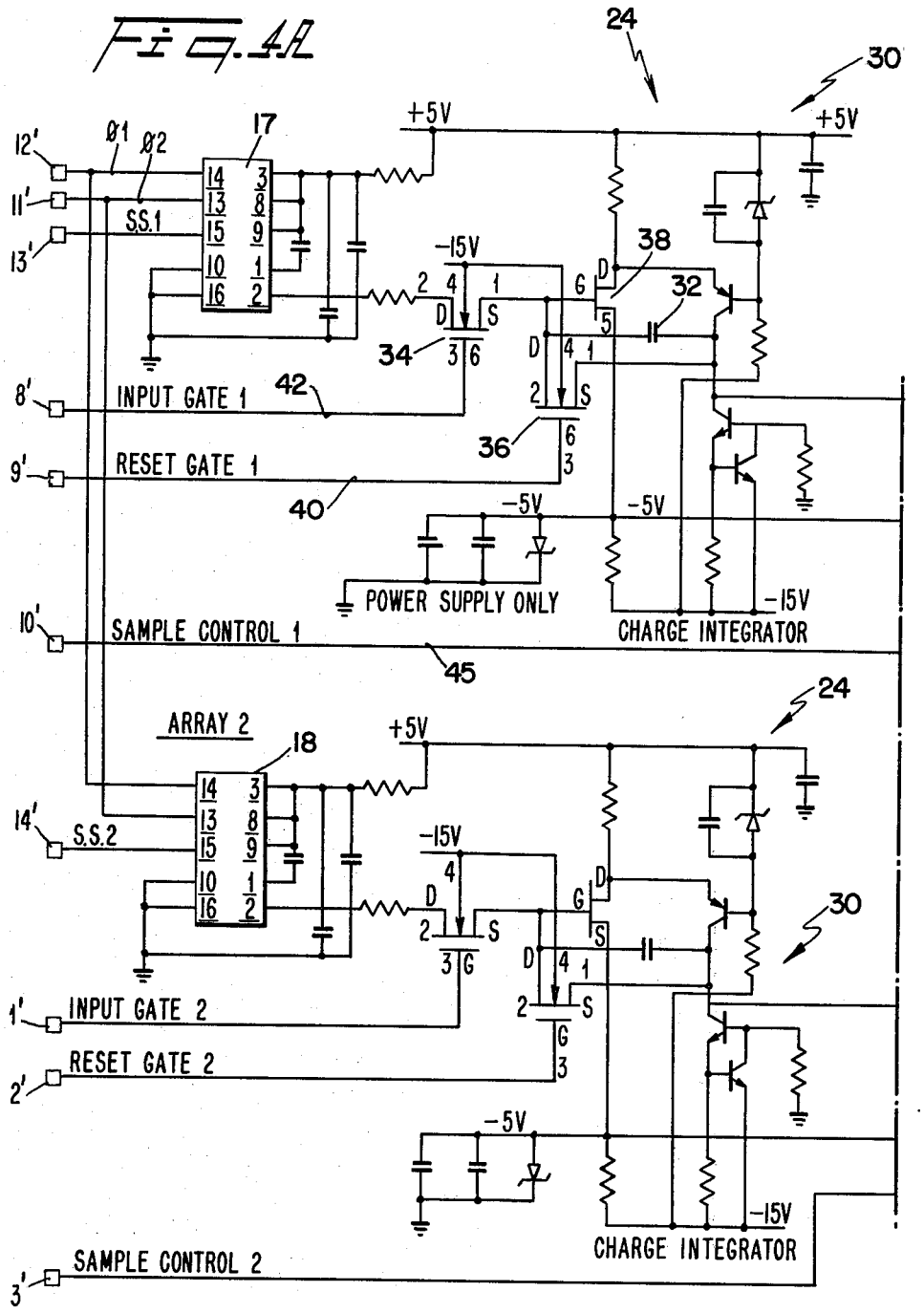
FIGS. 4A and 4B are a circuit diagram of the array circuit of FIG. 3.
Figure 4B:
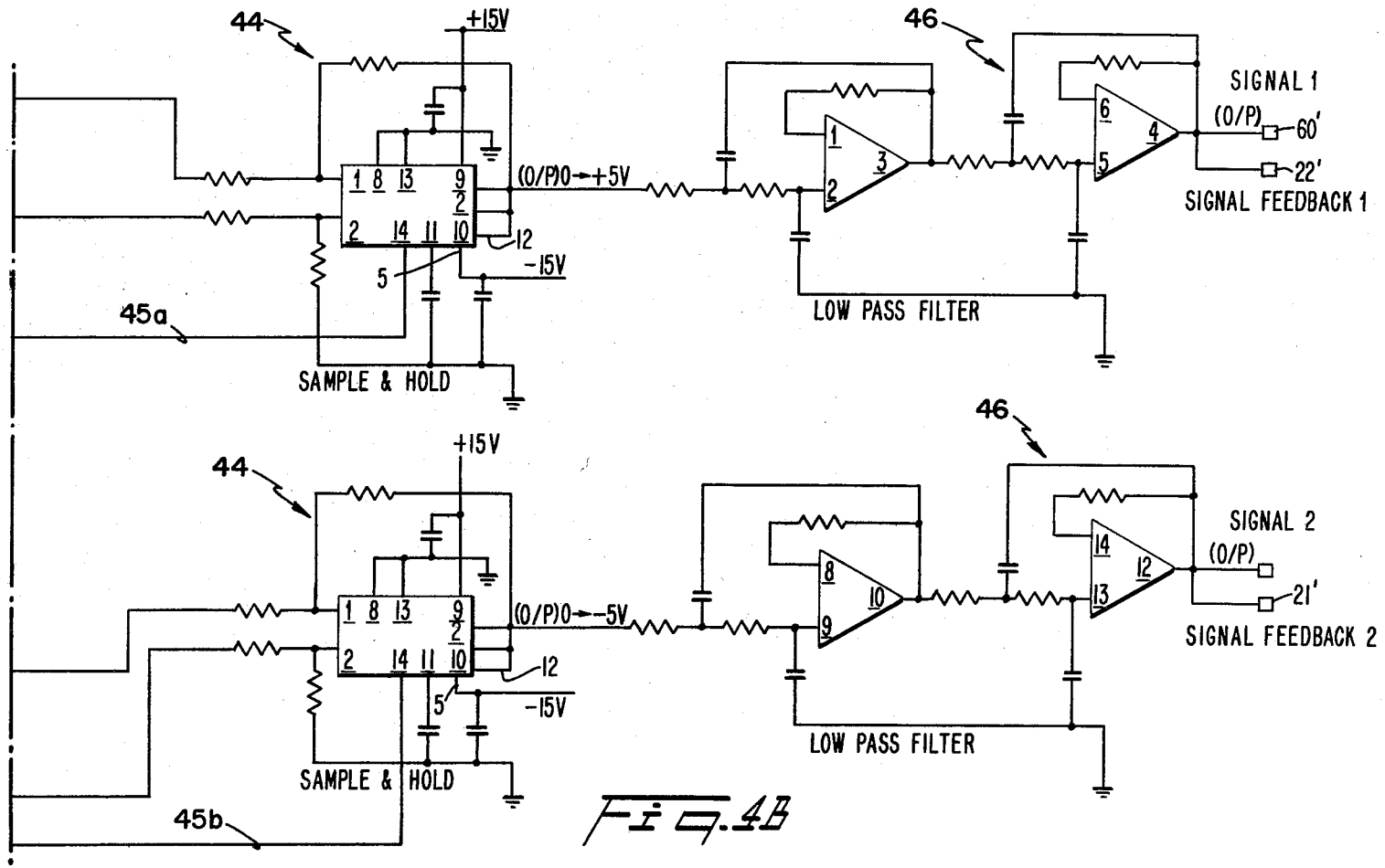

FIGS. 4A–4B disclose in detail the circuitry shown in blocks 17 and 18 in FIG. 3. Each sensor array 17, 18 which as aforementioned preferably is an IPL 104 comprises a linear array of silicon planar photodiodes, integrated with a dynamic M.O.S. shift register on a monolithic chip. The internal shift register is strobed at terminals 14 and 13 by two non-overlapping clock signals $\phi_1$ and $\phi_2$ respectively to cause sensor signals to be applied serially and in succession to output terminal 2. Scanning of each sensor array 17, 18 is initiated by a start scan pulse SS1, SS2 applied to terminal 15. The start scan pulse SS1, SS2 is then propagated through the internal register at a rate equal to twice the clock pulse repetition rate. Thus a new output sample is initiated alternately by the negative going edge of each clock pulse from both clock phases $\phi_1$, $\phi_2$. The output of each circuit 17, 18 at terminal 2 is supplied to amplification circuitry 24 including a charge integrator circuit 30 for storage of the successive charges on high speed integration capacitor 32 as well as sample and hold circuit 44 and low pass filter 46 (see FIG. 4B).

The charge integrator circuit 30 is controlled by synchronization signals applied to the gates of MOSFETs 34 and 36 in a conventional manner to stop, start and reset integration. Considering array 17, for example, each time a start scan pulse is applied to pin 15, charges are serially applied to pin 2 of the array while integrator 32 of charge integrator 30 has been reset by a signal on line 40. When the first cell of the required block of sensors is reached, integration of the output of array 17 is initiated by a signal on line 42 and the output of charge integrator 30 ramps negatively. After eight cell charge outputs have been generated, charge integrator 30 is placed in a hold condition by control signals applied on lines 40 and 42, and the stored charge is transferred to sample and hold circuit 44; chage integrator 30 is now reset by a signal applied on reset line 40.

Sample and hold circuit 44 is a conventional type HA2425 integrator circuit manufactured by Harris that is enabled to receive the charge stored on capacitor 32 by a control signal applied on sample control line 45. The output of sample and hold circuit 44 is supplied to low pass filter 46 to integrate or smooth the signal generated by the sample and hold circuit controlled by the signal on line 45.

Figure 9A:
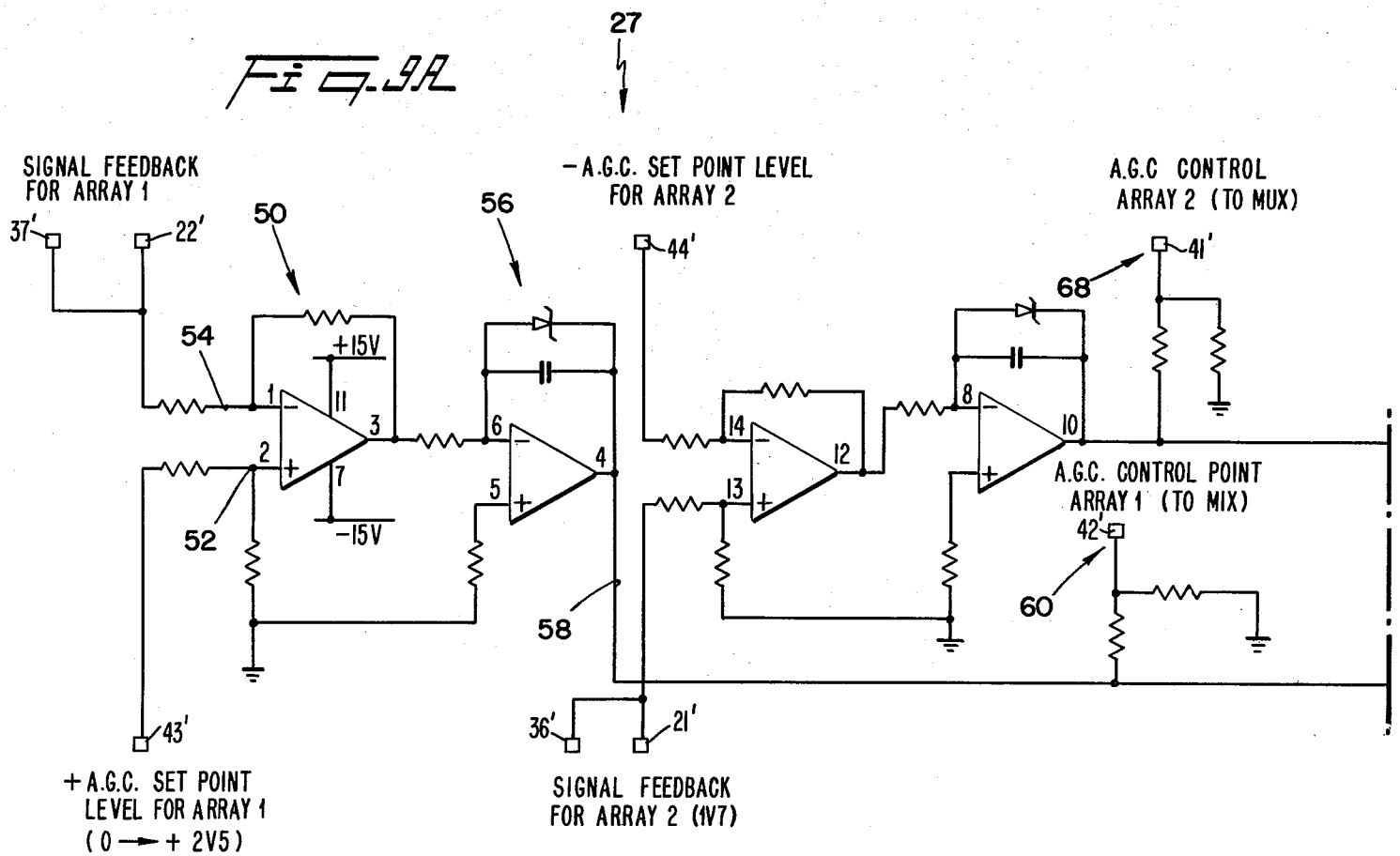
FIGS. 9A and 9B are a circuit diagram of the automatic gain compensator of FIG. 3.
Figure 9B:
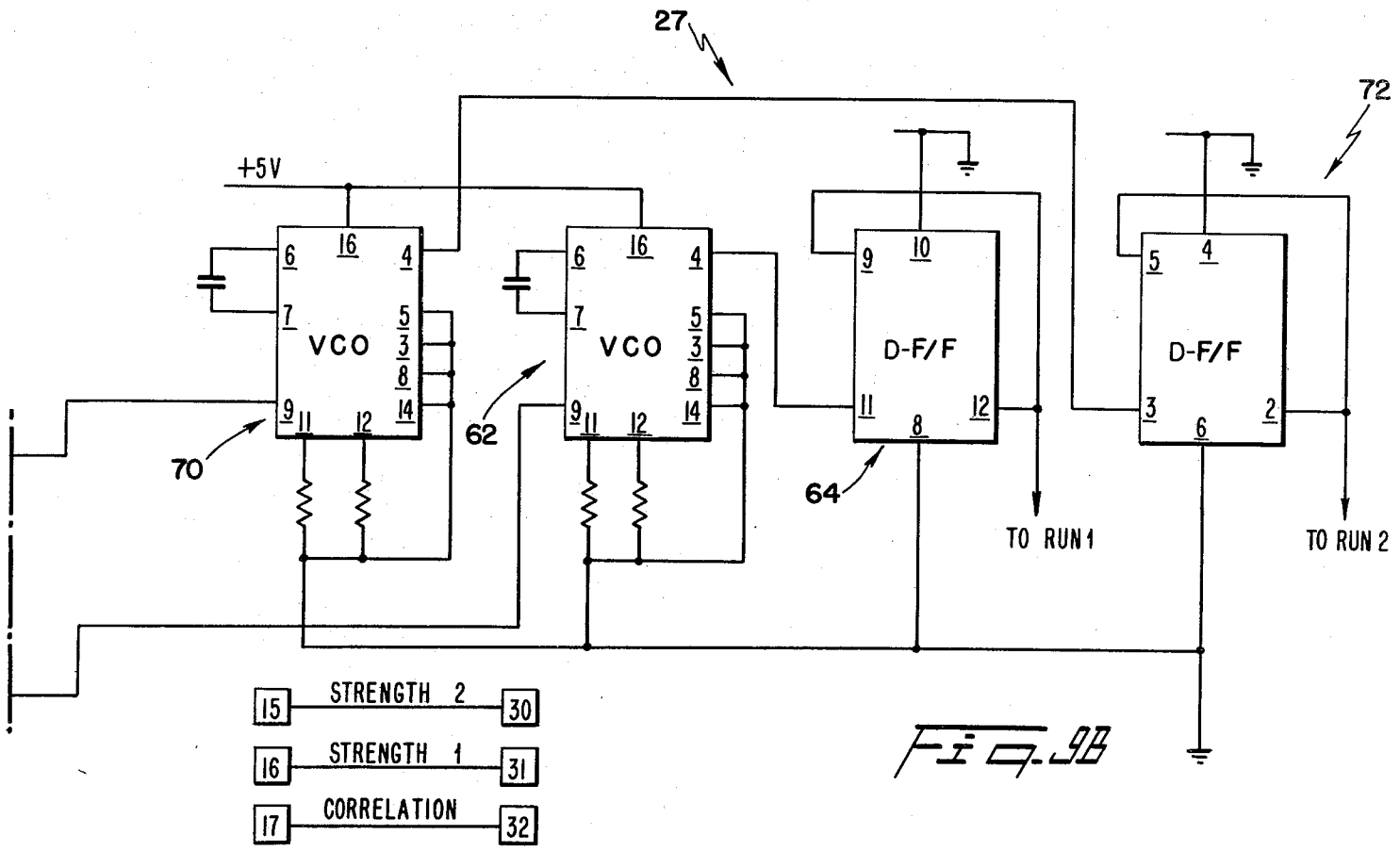

The rate at which start scan pulses are supplied to array 17, 18 is controlled by an optional gain circuit 27 shown in detail in FIGS. 9A and 9B. The gain control 27 controls the rate of the start scan pulses SS1 and SS2 applied respectively to arrays 17, 18 such that the longer the time between pulses, the greater the time for a charge to accumulate in the cells of the array and hence the greater the signal amplitude. The delay between start and scan signal SS1, for example, applied to array circuit 17, 18 and the start integrating signal applied to control line 42 of charge integrator 30 is dependent upon where the selected block of eight cells to be addressed is within the array.

Specifically, the automatic gain control amplifier 27 for each array comprises a first amplifier 50 in the form of a model 4136 operational amplifier or other conventional operational amplifier having one input terminal 52 connected to an AGC set point signal source (see FIG. 8C) and a second input terminal 54 connected to the output of low pass filter 46 in FIG. 4B. The output of amplifier 50 is supplied to a limiting amplifier 56 having an output at line 58 that is supplied to the AGC signal source 60 and to a voltage controlled oscillator (V.C.O.) 62, which may be the V.C.O. section of a type CD4046 Phase Lock Loop manufactured by RCA. The output of V.C.O. 62 is connected to D-type flip-flop 64 which may be a type CD4013 integrated circuit manufactured by RCA wired externally to operate as a divide-by-two element. The output of flip-flop 64 is supplied to master oscillator 66 (FIG. 5) of selector circuit 23. In a similar manner, the AGC gain control circuit corresponding to array 2 in FIG. 9A generates an AGC control signal at output terminal 68 and to V.C.O. 70 (FIG. 9B) which in turn controls flip-flop 72 to generate a second run signal that is supplied to master timer 66.

Referring to FIG. 5, master oscillator 66, which is a non-overlapping, two-phase oscillator with dual phase synchronizer, such as an NMC706 hybrid circuit manufactured by Newmarket Transistors, Ltd. in Newmarket, Suffolk, England, receives Run-1 and Run-2 signals generated by gain control circuit 27 shown in FIGS. 9A and 9B to generate two phase clock signals $\phi_1$ and $\phi_2$ through drivers 67 as well as reference signals for sequencer/selector circuits 74. Each circuit 74 may be a type NMC707 hybrid circuit also manufactured by Newmarket Transistors, Ltd. The contents of master oscillator 66 and of sequencer/selector circuits 74 shall not be described herein for brevity since each device is commercially available.

The master oscillator 66 also generates the start scan pulses SS1 and SS2 in synchronism with clock signal $\phi_1$. These start scan pulses are initiated by the positive going edges of Run-1 and Run-2. The sequencers 74 generate sample control signals to the sample and hold circuits 44*a*, 44*b*, input gate signals and reset gate signals of charge integrators 30*a*, 30*b* in correct time sequence relative to the start scan signals in response to control signals generated by microprocessor 100, discussed infra, stored in buffer 49 (FIG. 7C). The signals developed by sequencers 74 are stored in buffers 78 and 80. The outputs of buffers 78 and 80 in turn are supplied to charge integrator 30 shown in FIG. 4A.

Correlator circuit 25, shown in detail in FIG. 6, receives two analog voltage signals and develops one analog output signal that represents the degree of correlation between the two input signals. The two input signals are applied respectively at input terminals 82 and 84 for filtering in band pass filters 86 and 88. The frequency limited outputs of filters 86 and 88 are supplied, respectively, to zero cross over detectors 90 and 92 that convert the two filtered input signals to square waves. Amplitude detectors 94 and 96 generate outputs that indicate that valid input signals have been detected by the correlator. These output signals are supplied to a microcomputer 100. The signals generated by zero crossover detectors 90 and 92 are supplied to a digital correlator 98 which generates a signal related to the logical correlation between the input signals. The output of correlator 98 is supplied to low pass filter 99 to convert the correlator output to a d.c. voltage generally proportional to the correlation coefficient of the two signals.

Figure 7A:
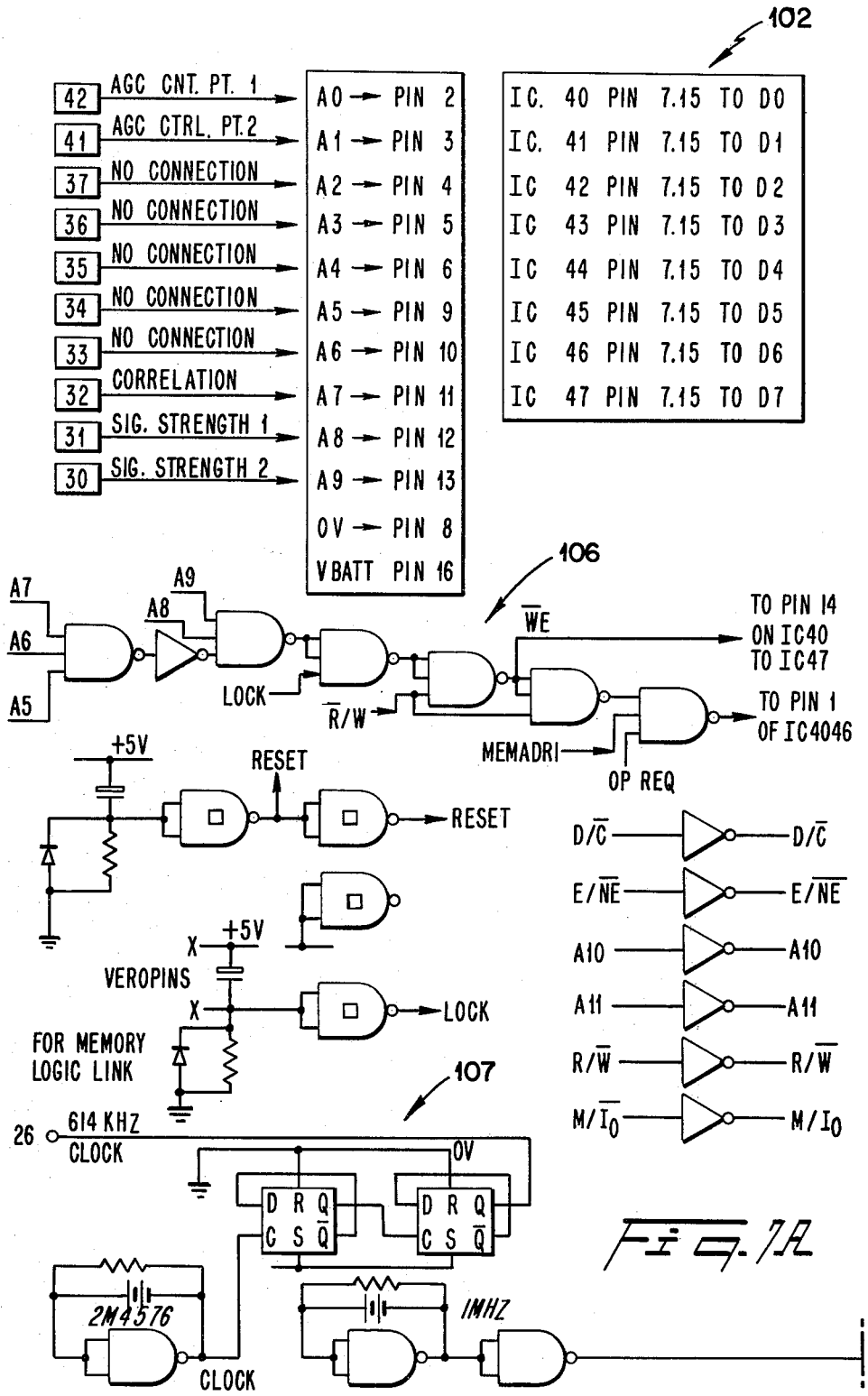
FIGS. 7A–7C are a circuit diagram of the control board 1 of FIG. 3.
Figure 7B:
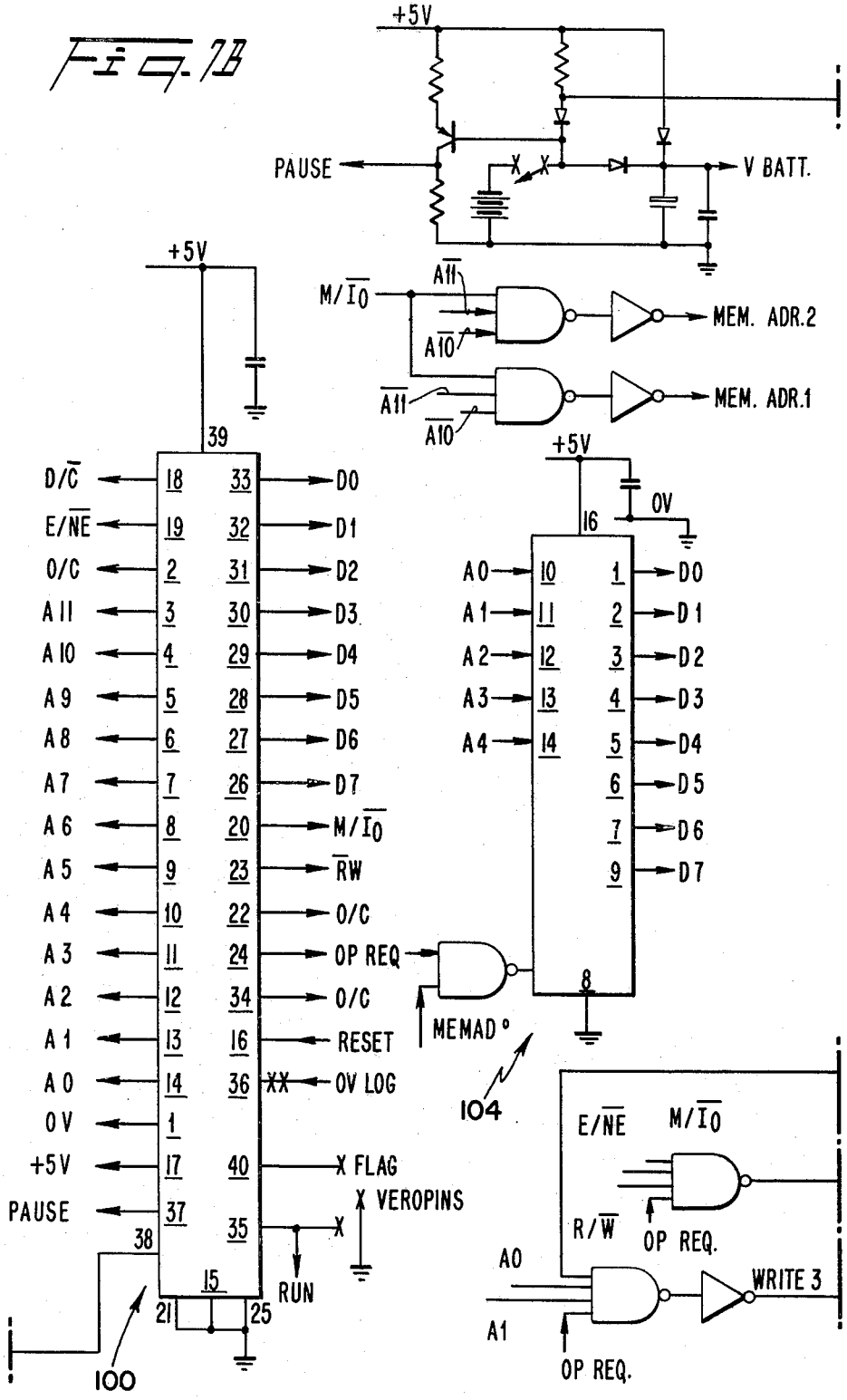
Figure 7C:
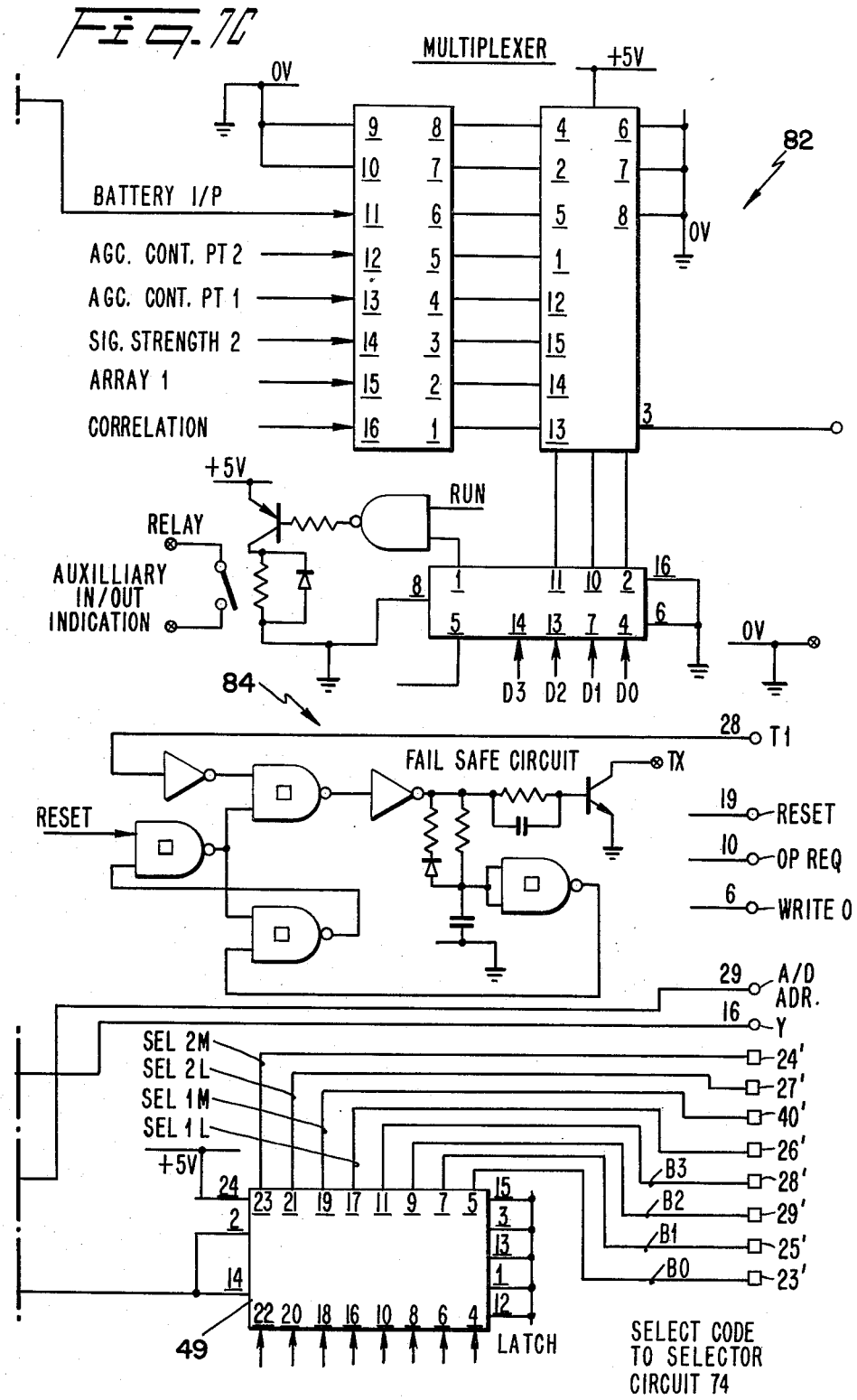

Referring to FIGS. 7 and 8, control system 26 includes a microcomputer 100 (FIG. 7B) including a central processing unit and main memory 102 (FIG. 7A) as well as a small programmable read only memory 104 (FIG. 7B). The main memory 102 may be of a type IM6508 and the programmable read only memory may be of a type 82S123. Also included is a conventional addressed decoder 106 (FIG. 7A) including an address lock to guard against accidental over-writing. Synchronization of computer 100 is provided by free running clock 107.

Figure 8A:
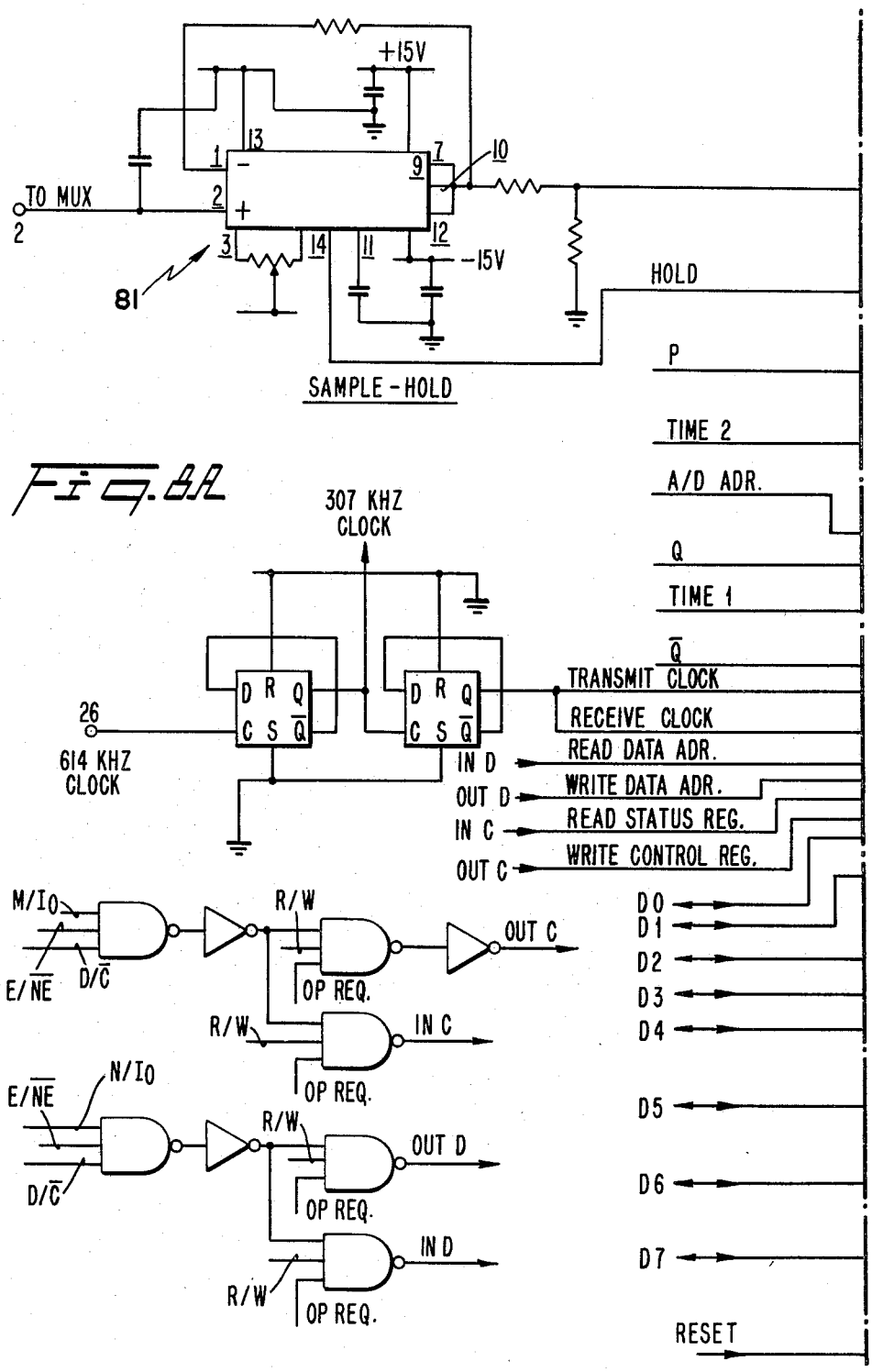
FIGS. 8A–8C are a circuit diagram of the control board 2 of FIG. 3.
Figure 8B:
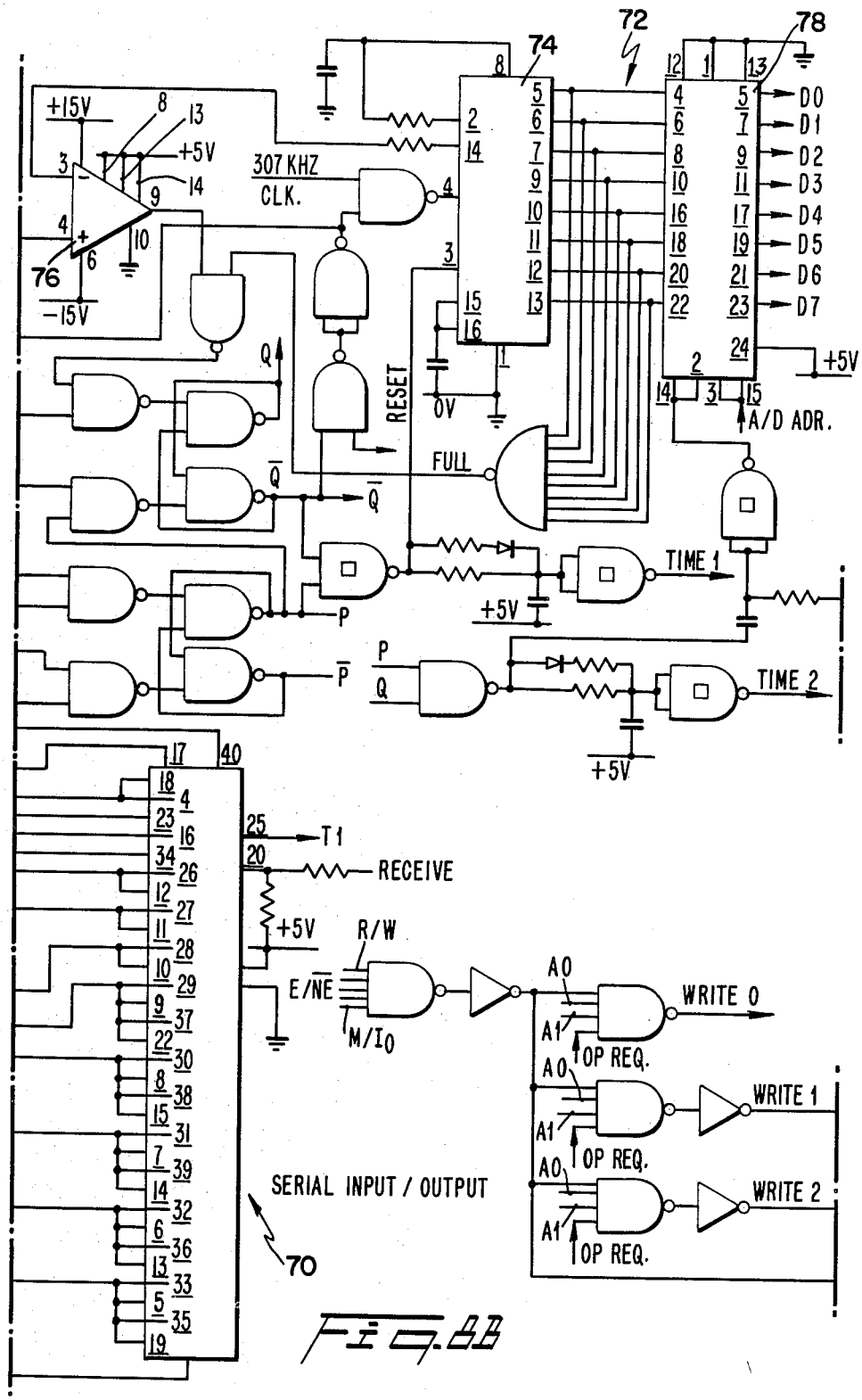

Referring to FIG. 8B, a circuit 70 is both a serial input port and a serial output port for interfacing microprocessor 100 for bit serial data transfer. Analog-to-digital converter 72 in FIG. 8B comprises a type ZN425E converter circuit 74 together with a type 527 integrated circuit comparator 76 connected within a feedback loop at the output of the converter 74. The output of converter 74 is supplied to a type CD4508 latch 78 that latches the result of the analog-to-digital conversion.

Sample and hold circuit 81 shown in FIG. 8A is controlled by sequence logic, thus ensuring that the signal supplied to A/D converter 72 to be converted is stable during the conversion period. Multiplexer 82 discussed supra (FIG. 7C) and its associated network controlled by address signals $D_0$–$D_3$ generated by sequencer 74 (FIG. 5C) multiplex eight analog signals, corresponding to a sensor array block of elements, into the converter 72. Conventional fail safe circuit 84 in FIG. 7C prevents any fault in the controller from disabling the transmit bus.

Figure 8C:
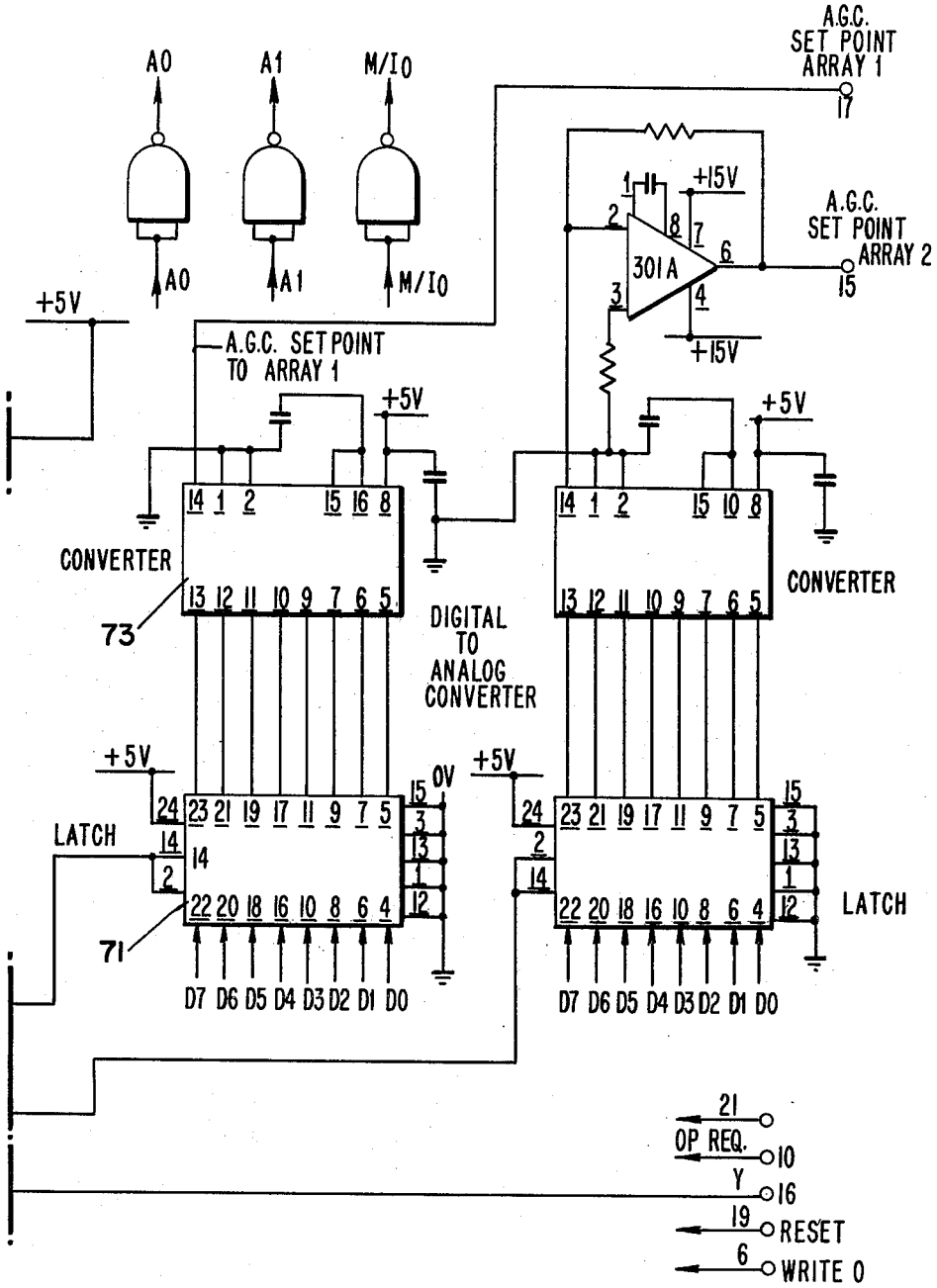

Referring to FIG. 8C, the AGC set point for each array 17, 18 used in the AGC circuit of FIG. 9 is developed by latch 71 and digital to analog converter 72, the two circuits 71, 73 being controlled by microprocessor 100 programmed in a known manner. The latch 71 may be, for example, a CD4508 integrated circuit; the converter 73 may be, for example, a ZN425E integrated circuit. The particular display device utilized is not critical. It can take any conventional visual form, and it is equally possible to have an audible alarm for both flame fault and flame out additional to or indeed in place of the visual display.

The equipment of the invention provides a considerably more efficient monitoring of flames than has hitherto been possible. By the selection of an appropriate sensor element, e.g., a silicon cell when a pulverized fuel flame is involved, which sensor element is light sensitive to a degree suited to the flame being monitored, any flame can be monitored by the invention. As has been mentioned above, the invention has the additional advantage of an ability to simultaneously monitor two flames such as a pulverized fuel flame and its igniting oil fuel flame.

Although the above description has referred to one monitoring device and its associated control, it will be understood that in a boiler having a number of burners, each burner would be provided with a monitoring device in accordance with the invention, and when the visual or audible signalling of the flame condition would be arranged accordingly.

What we claim is:

1. A method of monitoring a selected flame in a multiburner furnace comprising positioning two arrays of photoelectric sensors, providing an optical path for the sensors of each array so that the line of sight of one sensor of one array will intersect the line of sight of one sensor of the other array, electronically scanning the two arrays to determine the sensors, one from each array, which give maximum correlation of output signal from the sensors and electronically locking onto those two sensors to monitor the selected flame.

2. A method of monitoring a flame as in claim 1, wherein the optical path for each array of sensors is provided by a lens arrangement between the array of sensors and the flame, one array of sensors and its lens being so positioned in relation to the other array of sensors and its lens that the sight paths of the two arrays always cross at a distance farther than approximately 5 feet from the lenses.

3. A method of monitoring a flame as in claim 1, wherein following detection of two sensors one from each array giving output signals of maximum correlation, the degree of correlation is then electronically optimized.

4. A method of monitoring a flame as in claim 3, wherein each sensor of each array is formed as a block of sensor elements for initial scanning purposes, the individual block of one array determined during the scanning procedure as being the block of that array giving maximum correlation, that individual block is moved first in one direction and then in the other by electronic means, by the addition of one element at one end and the elimination of one element at the other end until the block of eight elements of that array provides a new maximum correlation, the individual block of the other array determined on first scanning as giving maximum correlation being dealt with in similar manner again by moving the block by one element at a time first in one direction and then the other until an absolute maximum correlation has been achieved.

5. A method of monitoring a flame as in any of claims 1 to 4, wherein when monitoring a pulverized fuel flame ignited by an oil flame, the sensor arrays are scanned and optimized and the appropriate sensors for each flame thereby determined.

6. A monitoring device for flames in multi-burner furnaces comprising two arrays of photoelectronic sensors, lens means associated with each array to provide an optical path for the sensors of each array, the lines of sight of which intersect, electronic means to scan the two arrays to detect the sensors, one from each array, giving maximum correlation of output signal, and electronic means to optimize the output signals from the sensors of each array.

7. A method of monitoring a flame as in claim 1, including detecting a faulty or extinguished flame as a function of degree of correlation of output signals from said sensors.

* * * * *